US006054806A

United States Patent [19]

Holzer

[11] Patent Number: 6,054,806

[45] Date of Patent: Apr. 25, 2000

[54] SINGLE-BASED GAS DISCHARGE VESSEL FOR ENERGY-SAVING LAMPS

[76] Inventor: Walter Holzer, Drosteweg 19, D-88709 Meersburg, Germany

[21] Appl. No.: 09/007,523

[22] Filed: Jan. 15, 1998

[30] Foreign Application Priority Data

Dec. 15, 1997 [DE] Germany ..... 197 55 680

[51] Int. Cl.[7] ..... H01J 1/62; H01J 63/04; H01J 17/16; H01J 61/30

[52] U.S. Cl. ..... 313/493; 313/318.09; 313/634; 220/2.1 R

[58] Field of Search ..... 313/110, 484, 313/493, 318.02, 318.09, 610, 634; 428/690; 439/611–12; 315/56–58, 50, 71, 61–63, 53; 362/260; 220/12.1 R, 2.3 R

[56] References Cited

U.S. PATENT DOCUMENTS 3,764,844 10/1973 Schmidt ..... 313/110
5,128,590 7/1992 Holzer ..... 313/493 X
5,705,883 1/1998 Soules et al. ..... 313/634 X
5,731,659 3/1998 Soules et al. ..... 313/493 X
5,751,104 5/1998 Soules et al. ..... 313/493

*Primary Examiner*—Nimeshkumar D. Patel
*Assistant Examiner*—Mack Haynes
*Attorney, Agent, or Firm*—Marshall, O'Toole, Gerstein, Murray & Borun

[57] ABSTRACT

The invention concerns a gas discharge lamp or vessel wherein at least part of the lamp is in the form of a spiral. The windings of the coils forming the spiral are tightly-spaced (less than 1 mm apart). In addition to providing high amounts of light, the compact packaging resulting from the design offers safety advantages in that the electrical contacts are located deep within the vessel interior. Thus, the opportunity of contacting live electrical contacts in the event of glass breakage is lessened.

12 Claims, 1 Drawing Sheet

A
A

SINGLE-BASED GAS DISCHARGE VESSEL FOR ENERGY-SAVING LAMPS

BACKGROUND OF THE INVENTION

Coiled gas discharge vessels for energy-saving lamps have proven themselves increasingly in recent years, since they offer better light distribution, a smaller design length and an aesthetic appearance. However, all energy-saving lamps thus far available in the marketplace are designed as a double coil with the shortcoming that their production is costly and intricate.

SUMMARY OF THE INVENTION

The task of the invention is to describe a space-saving and attractive lamp that is cost-effective to manufacture and can also be easily adapted to different outputs. Its dimensions, if possible, should not surpass the size of ordinary incandescent lamps.

According to the invention this is accomplished by providing a gas discharge vessel, which is base-mounted on one side of the housing and which is arranged as a singly coiled spiral. The windings of the coil are arranged with a minimal spacing of less than 1 mm or, if possible, so that the windings are directly adjacent (i.e., they touch). Since the gas discharge vessel is adapted to be base-mounted on one side, the other end of the glass tube is guided back to the housing within the coil windings. The glass discharge vessel can be formed from a single tube having a first, singly-coiled spiral section, and a second, uncoiled section extending vertically within the spiral. Alternatively, two tubes can be welded together.

This type of gas discharge vessel can be manufactured particularly simply if it is assembled from two parts, namely, a coil and a straight glass tube that are melted together.

The straight part of the glass tube is advantageously melted with the coil roughly in the helix of the coil.

The design of a gas discharge vessel according to the invention permits production of lamps with an extremely small diameter. For this reason it is recommended that the windings of the coil be wound on the straight part of the glass tube (i.e., by using the straight glass tube portion as a mandrel). This type of design is facilitated and favored by a sleeve that is pushed onto the straight part of the glass tube and on which the windings of the coil at least partially lie. The electrodes should then be positioned to lie in the straight glass tube within the sleeve, if possible.

If the sleeve is designed so that it is at least partially conducting on its surface, it represents a starter for triggering the gas discharge.

A conducting sleeve can also be connected as grounding contact to the line voltage and in so doing itself forms an absolute safety in the event of glass breakage.

This design presents an additional safety feature in that the electrodes are arranged on the end of the coiled glass tube sufficiently deep within the housing, thus preventing contact in the case of breakage.

In compact lamps with an integrated ballast it is recommended according to the invention that at least some components of the ballast be arranged in the interior of the coil in order to preserve the design length of the lamp.

Since the gas discharge vessel represents a closed element, it is recommended that the housing be designed in one part so that the gas discharge vessel can be placed as a cover on the housing.

BRIEF DESCRIPTION OF THE DRAWINGS

The following figures schematically depict the idea of the invention in two examples.

FIG. 3*a* is a view of the lamp of FIG. 3 seen from above.

DETAILED DESCRIPTION OF THE PREFERRED EMBODIMENT

Figures 1, 1A, 2, 3, 4, 4A, 5, 5A:
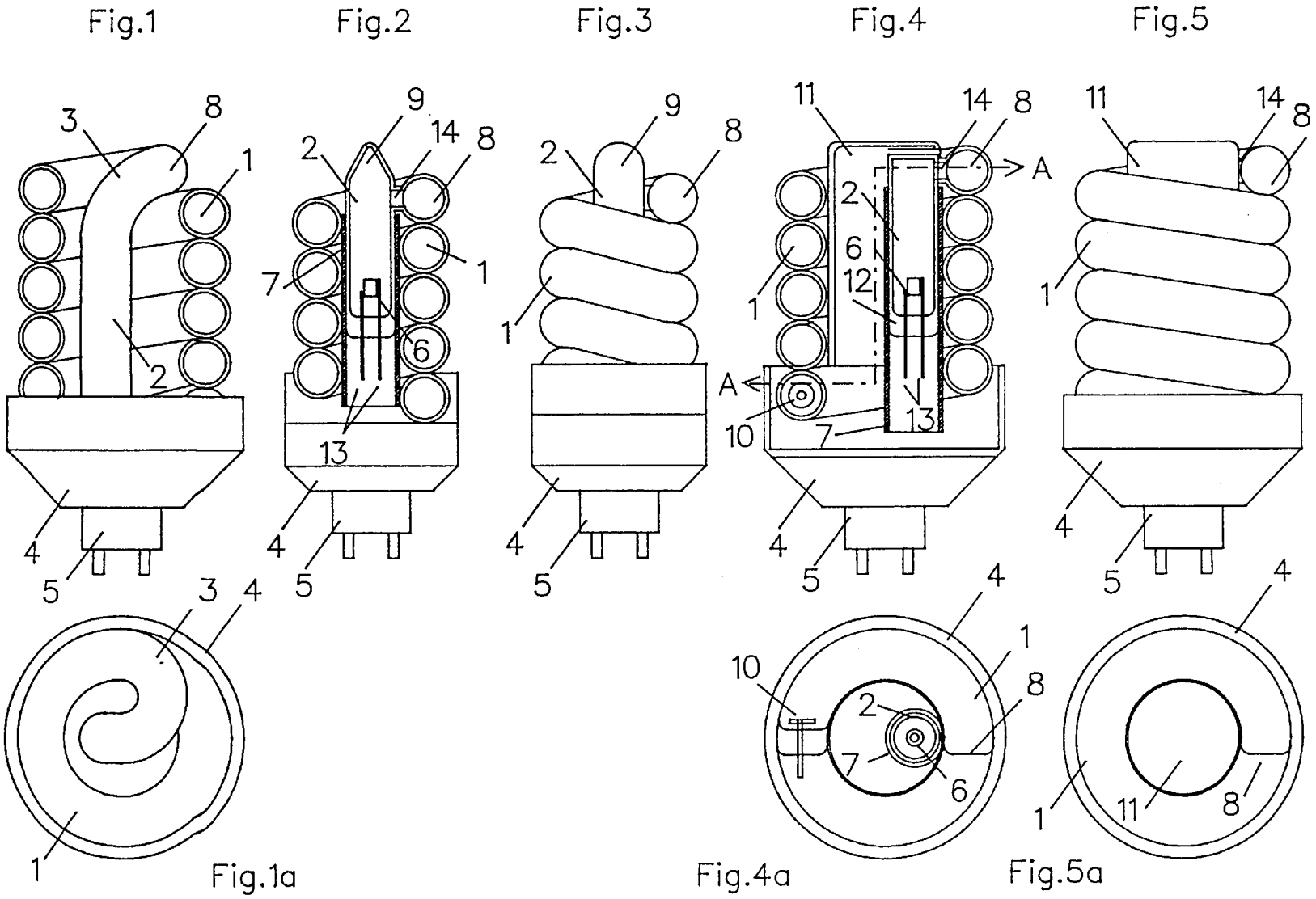
FIG. 1 shows a tightly wound coil lamp according to the invention in cross section.
FIG. 1*a* is the corresponding top view of the apparatus of FIG. 1.
FIG. 2 is a section through a lamp with an extremely tightly wound coil, which is mounted directly on the internal tube with sleeve.
FIG. 3 shows a side elevational view of the lamp of FIG. 2.
FIG. 4 is an example of a lamp according to the invention for larger outputs in cross section.
FIG. 4*a* is a cross section along line A—A.
FIG. 5 shows a view of a lamp which is designed for higher light outputs.
FIG. 5*a* is a view of the lamp of FIG. 5 seen from above.

The following detailed description of the lamp examples is schematic and in no way should be understood as limiting with reference to the scope of the invention.

FIG. 1 already shows the enormous gain in design length of the glass coil (1), whose windings lie tightly against each other. The straight part of glass tube (2) has a bend (3) on the top and then grades into the wound glass tube (1). The coil (1) and straight part of glass tube (2) terminate in housing (4), which carries a pin base (5). The pin base (5) is part of a new protected-type base/socket system according to German Patent Application 197 06 905.3 with numerous advantages over the previously common Edison sockets or bayonet sockets. It goes without saying that a gas discharge vessel according to the invention can be equipped with another form of a housing or base. FIG. 1*a* shows in a view from above the simple shape of the lamp in FIG. 1.

The lamp depicted in cross section in FIG. 2 still possesses significant advantages according to the invention. In this lamp the coiled glass tube (1) and the straight part of glass tube (2) are joined at welding site (14) and the wound glass tube (1) tightly encloses the sleeve (7), which is pushed onto the straight part of glass tube (2).

The sleeve (7) has several tasks to fulfill. It first mechanically protects the straight glass tube (2) against the wound glass tube (1).

If the sleeve (7) is produced from an electrically conducting material or at least the surface of the sleeve (7) is provided with a conducting layer, a significant reduction in ignition voltage is achieved in gas discharge lamps and operational safety is increased. A direct or high-ohmic connection with an electrode potential or network grounding can further increase this effect. Connection of sleeve (7) with a ground potential gives the lamp additional contact protection, even during glass breakage. Electrode (6) is arranged well within sleeve (7) so that it cannot be touched even when the glass is broken. Electrode (6) is mounted, for example, with a pinch base (12) in straight glass tube (2). Components of an electronic ballast or other current-limiting means for gas discharge can be accommodated in housing (4).

FIG. 3 shows a view of the lamp in FIG. 2. In this depiction the straight glass tube (2) is shown protruding well above weld site (14). In this example a particularly favorable effect of gas discharge is to be expected, since a distinct cooling spot (9) is formed by the upper end (8).

To achieve greater light output, the diameter of the coil is increased in the simplest case. In this fashion sufficient space is obtained between the wound glass tube (1) for a cap (11), which can accept at least part of the components of an electronic ballast (FIG. 4). Here again the straight glass tube (2) is surrounded by a sleeve (7) in order to reduce the ignition voltage of the gas discharge tube and to protect the straight glass tube (2) from mechanical damage. The wound glass tube (1) extends deeply into housing (4) so that the electrode (10) is in a protected region even during glass breakage. The terminals (13) that connect electrode (10) to the ballast are only indicated. They can be designed at the option of the designer as soldered or plug-in connections, depending on the type of mounting and type of design preferred.

It can also be clearly seen in FIG. 4 that the cap (11) together with the wound glass tube (1) almost completely seals the housing (4) so that the upper part of housing (4) is dispensable as cover. The wound glass tube can be screwed helically into corresponding recesses of housing (4). It is recommended that the coiling of glass tube (1) be a left thread so that the lamp when unscrewed from a screw thread remains reliably connected to housing (4).

FIG. 4*a* shows a cross section along line A—A in order to better reveal the position of the individual parts.

FIG. 5 is a view of the lamp in FIG. 4 which makes the advantages according to the invention particularly clear for a compact energy-saving lamp. The closed light field with optionally, absolutely symmetric all-round distribution of the light should also be emphasized. The corresponding view in the axial direction from above is shown in FIG. 5*a* with the corresponding design.

To summarize, it can be stated that not only is a maximal solution achieved by the combination of individual features of the invention, but each feature of the invention itself already offers a significant improvement to the prior art. Details for additional improvements according to the invention that enrich the prior art are also recognizable from the individual figures. They are to be viewed as part of the indirect scope of protection of the invention.

What is claimed is:

1. A gas discharge vessel for energy-saving lamps, base-mounted on one side in a lamp housing, comprising:

a glass tube having electrodes mounted at the ends thereof, a first portion of said glass tube forming a singly-coiled spiral about a center region, and whose windings are arranged with a spacing less than 1 mm; and a second portion of said glass tube comprising an uncoiled vertical tube portion within said spiral center region.

2. A gas discharge vessel according to claim 1, characterized by the fact that the glass tube is assembled from two parts, namely, a coil and a straight glass tube that are melted together.

3. A gas discharge vessel according to claim 2, characterized by the fact that the two parts of the glass tube are melted together crossed roughly in the helix angle of the coil.

4. A gas discharge vessel according to claim 1, characterized by the fact that the straight part of the glass tube protrudes above the coil and is designed as cooling spot and/or as exhaust vent.

5. A gas discharge vessel according to claim 1, characterized by the fact that the windings of the coil are wound on the straight part of the glass tube.

6. A gas discharge vessel according to claim 1, characterized by the fact that a sleeve is pushed onto the uncoiled glass tube portion on which the windings of the coiled first portion at least partially lie.

7. A gas discharge vessel according to claim 6, characterized by the fact that an electrode lies in the uncoiled glass tube portion within the sleeve.

8. A gas discharge vessel according to claim 6, characterized by the fact that the sleeve has a conductive surface portion and serves as a starter.

9. A gas discharge vessel according to claim 8, characterized by the fact that the conducting sleeve is connected as a grounding contact.

10. A gas discharge vessel according to claim 1, characterized by the fact that the end of the wound glass tube with the electrode is arranged within the housing.

11. A gas discharge vessel according to claim 1, characterized by the fact that a ballast to limit the gas discharge current is accommodated in the housing and at least some components of the ballast lie within said spiral center region.

12. A gas discharge vessel according to claim 1, characterized by the fact that the housing is designed in one part and the gas discharge vessel is designed as a cover of the housing.

* * * * *